US009541041B2

(12) United States Patent
Grieser et al.

(10) Patent No.: US 9,541,041 B2
(45) Date of Patent: Jan. 10, 2017

(54) INJECTION VALVE

(71) Applicant: Ford Global Technologies, LLC, Dearborn, MI (US)

(72) Inventors: Klemens Grieser, Lengenfeld (DE); Oliver Berkemeier, Bergisch Gladbach (DE); Jens Wojahn, Bergisch Gladbach (DE); Jan Linsel, Cologne (DE); Kay Hohenboeken, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 199 days.

(21) Appl. No.: 13/960,715

(22) Filed: Aug. 6, 2013

(65) Prior Publication Data

US 2014/0048035 A1 Feb. 20, 2014

(30) Foreign Application Priority Data

Aug. 15, 2012 (DE) ..... 10 2012 214 522

(51) Int. Cl.
*F02B 3/00* (2006.01)
*F02M 27/02* (2006.01)
*F02M 63/00* (2006.01)

(52) U.S. Cl.
CPC ..... *F02M 27/02* (2013.01); *F02M 63/0036* (2013.01); *F02M 2200/90* (2013.01)

(58) Field of Classification Search
CPC ..... F02M 61/18; F02M 61/188; F02M 61/06; F02M 61/1806; F02M 61/166; F02M 61/1866; F02M 63/0078; F02M 61/1886; F02B 2075/125; F02B 2275/14
USPC ... 239/469, 470, 584, 585.1–585.5; 123/294, 123/298
See application file for complete search history.

(56) References Cited

U.S. PATENT DOCUMENTS 4,158,442 A * 6/1979 Rathmayr ..... 239/88
4,360,161 A * 11/1982 Claxton et al. ..... 239/463
4,394,973 A * 7/1983 Sauer et al. ..... 239/467
4,483,485 A * 11/1984 Kamiya et al. ..... 239/585.4
4,767,061 A * 8/1988 Ingemansson ..... 239/566
5,221,046 A * 6/1993 Timmer ..... 239/88
(Continued)

FOREIGN PATENT DOCUMENTS

CN 1359448 A 7/2002
DE 19802883 A1 8/1999
(Continued)

OTHER PUBLICATIONS

Partial Translation of Office Action of Chinese Patent Application 201310356022.7, Issued Nov. 4, 2016, State Intellectual Property Office of PRC, 10 pages.

*Primary Examiner* — Marguerite McMahon
*Assistant Examiner* — Tea Holbrook
(74) *Attorney, Agent, or Firm* — Julia Voutyras; Alleman Hall McCoy Russell & Tuttle LLP

(57) ABSTRACT

An injection valve for injecting fuel into a combustion chamber of an internal combustion engine comprises a valve seat, a valve element, at least one injection opening formed in the valve seat and leading to the combustion chamber, the at least one injection opening opened or closed by a stroke motion of the valve element, a catalytic coating provided in a region of the injection valve which faces the combustion chamber, and at least one protuberance which is elongated in a direction of the combustion chamber and projects into the combustion chamber.

18 Claims, 3 Drawing Sheets

(56) References Cited

U.S. PATENT DOCUMENTS 5,234,170 A * 8/1993 Schirmer et al. ..... 239/690
5,662,277 A * 9/1997 Taubitz et al. ..... 239/585.4
5,685,491 A * 11/1997 Marks ..... F02M 61/1853 205/70
5,921,469 A * 7/1999 Romann ..... 239/397.5
6,070,811 A * 6/2000 Takeda et al. ..... 239/533.12
6,161,781 A * 12/2000 Kojima ..... F02M 61/1833 239/533.12
6,267,307 B1 * 7/2001 Pontoppidan ..... F02M 61/06 239/104
7,331,535 B2 * 2/2008 Lambert ..... F02M 61/16 239/132
7,343,895 B2 * 3/2008 Mark ..... F02M 53/08 123/27 GE
7,481,201 B2 * 1/2009 Holzgrefe et al. ..... 123/470
2003/0116653 A1 * 6/2003 Doll ..... F02B 23/0669 239/533.12
2005/0121543 A1 * 6/2005 Sayar ..... 239/533.12
2006/0096570 A1 * 5/2006 Tourteaux ..... F02B 17/005 123/266
2007/0095952 A1 * 5/2007 Heinstein ..... F02M 51/0671 239/585.1
2008/0029623 A1 * 2/2008 Sugiyama et al. ..... 239/569
2008/0217439 A1 9/2008 Pilgram et al.
2009/0050717 A1 * 2/2009 Takase ..... 239/533.12
2009/0321541 A1 * 12/2009 Holzgrefe et al. ..... 239/553.3
2010/0126471 A1 * 5/2010 Cheiky et al. ..... 123/476
2010/0224706 A1 * 9/2010 Suzuki ..... C23C 14/165 239/584
2011/0315793 A1 * 12/2011 Michlik et al. ..... 239/533.3
2013/0048748 A1 * 2/2013 Imoehl ..... 239/5

FOREIGN PATENT DOCUMENTS

DE 19951014 A1 1/2001
DE 10118163 A1 10/2002

* cited by examiner

INJECTION VALVE

CROSS REFERENCE TO RELATED APPLICATIONS

The present application claims priority to German Patent Application No. 102012214522.2, filed on Aug. 15, 2012, the entire contents of which are hereby incorporated by reference for all purposes.

FIELD

The present disclosure relates to an injection valve for injecting fuel into the combustion chamber of an internal combustion engine.

BACKGROUND AND SUMMARY

In the case of direct injection of fuel into the combustion chamber of an internal combustion engine, the problem arises that deposits in the form of fuel deposits or soot particles occur in the region of the injection valve tip projecting into the combustion chamber. These can have a negative effect, on the one hand, on the emissions characteristics of the internal combustion engine and also, on the other hand, on the operating parameters of the injection valve.

To overcome this problem, DE 199 51 014 A1, for example, discloses the application of coatings at the combustion-chamber end of the injection valve, said coatings being used to bring about catalytic conversion or combustion of the unwanted deposits.

Even when such catalytic coatings are used at the combustion-chamber end of the injection valve, however, there is the additional problem during the operation thereof that the temperatures which occur in the region of the catalytic coatings during normal engine operation are often insufficient to ensure effective progress of the desired catalytic reactions, and, in particular, the "light off temperature" of the catalytically active layer is often not reached. As a consequence, it may happen that the special catalytic coating used does not achieve the intended effect and, as a result, impairments of valve operation and also increased emissions from the internal combustion engine may occur owing to the residual fuel and soot particle deposits.

Given the above background situation, the inventors herein provide an injection valve for injecting fuel into the combustion chamber of an internal combustion engine which allows increased elimination of unwanted deposits on the combustion chamber end section of the injection valve and hence an improvement in the operating behavior of the injection valve and in the emissions characteristics of the internal combustion engine during the operation of the internal combustion engine.

Accordingly, an injection valve for injecting fuel into a combustion chamber of an internal combustion engine comprises a valve seat, a valve element, at least one injection opening formed in the valve seat and leading to the combustion chamber, the at least one injection opening opened or closed by a stroke motion of the valve element, a catalytic coating provided in a region of the injection valve which faces the combustion chamber, and at least one protuberance which is elongated in a direction of the combustion chamber and projects into the combustion chamber.

In this way, the injection valve of the present disclosure allows improved elimination of deposits (e.g. fuel) in the region of the injection valve tip projecting into the combustion chamber and hence also more favorable emissions characteristics of the internal combustion engine by way of more efficient use of existing catalytic coatings.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
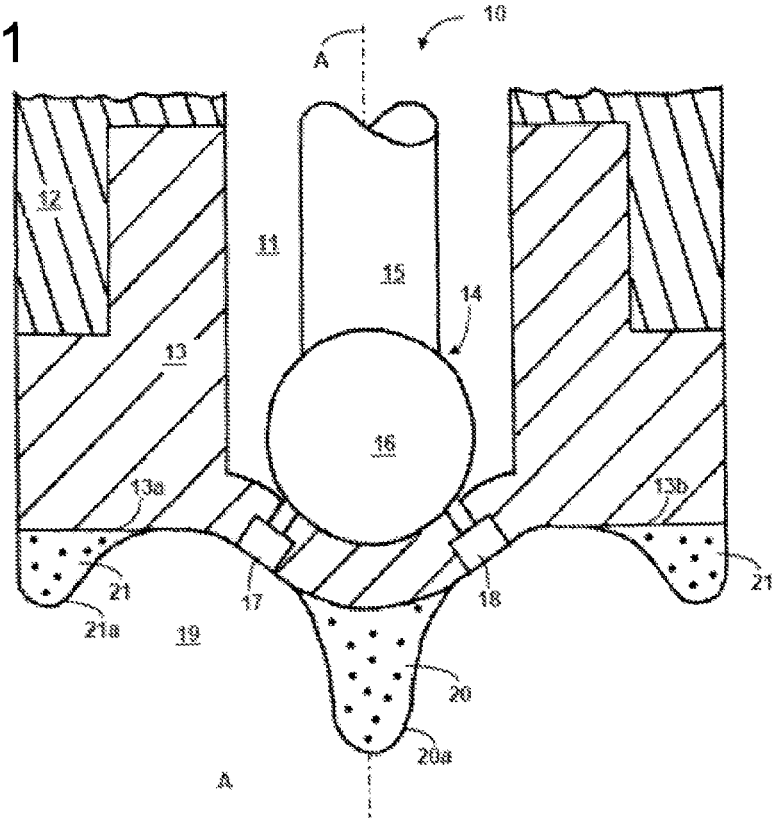
FIG. 1 shows a schematic illustration of an injection valve according to one embodiment of the disclosure.

Direct injection engines may accumulate deposits of fuel and/or combustion products on the fuel injectors. Such deposits may negatively influence emissions. Catalytic coatings on the injector tips can remove the deposit layer via exothermic reactions occurring between the catalytic coating and the deposits, but light-off temperatures wherein the exothermic reactions occur are unlikely to be reached during normal engine operation. According to embodiments disclosed herein, the injector tips may include protuberances that project into the combustion chamber, providing a shape of the injector tip that offers a larger surface to the combustion chamber, raising the injector tip temperature due to the higher heat input from the combustion process. The protuberances or bulges may be designed such that way that they do not constrain the spray of the injector.

In one example, the protuberance can have an axial extent, in particular in relation to the longitudinal axis of the injection valve, which is at least 50%, in particular at least 75%, of the extent of said protuberance in a direction perpendicular to the longitudinal axis of the injection valve. According to one embodiment, the injection valve has at least two protuberances projecting into the combustion chamber.

According to another approach, an injection valve according to the disclosure for injecting fuel into the combustion chamber of an internal combustion engine has a valve seat and a valve element, wherein at least one injection opening formed in the valve seat and leading to the combustion chamber can be opened or closed by a stroke motion of the valve element, wherein a catalytic coating is provided in a region of the injection valve which faces the combustion chamber, and wherein the injection valve has at least two protuberances projecting into the combustion chamber.

In both of the approaches above, the disclosure is based, in particular, on the concept of configuring that section of the injection valve which faces the combustion chamber in such a way in terms of the shape or geometry thereof that, by providing a larger surface in the section adjoining the combustion chamber, increased absorption of thermal energy from the combustion chamber and hence an increased supply of heat to the region of the catalytic coating occurs, with the result that temperature ranges within which the catalytic processes required to remove the unwanted deposits take place are reached more quickly and/or more often. In particular, the increased absorption of thermal energy from the combustion chamber has the effect that the light off temperature of the catalytic coating is exceeded more quickly and more often.

According to one embodiment, the injection valve has a first protuberance, which is arranged radially on the inside in relation to the longitudinal axis of the injection valve, and a second protuberance, which is arranged radially on the outside in relation to the longitudinal axis of the injection valve. In particular, the first protuberance can have a substantially conical geometry which tapers in the direction of the combustion chamber. The second protuberance can be designed as an encircling collar, in particular in relation to the longitudinal axis of the injection valve.

According to one embodiment, the injection valve has a plurality of injection openings, which are arranged obliquely to the longitudinal axis of the injection valve. In this case, the injection openings can be arranged between the first protuberance and the second protuberance, in particular in the radial direction. The protuberance(s) provided according to the disclosure on the injection valve are configured in terms of the positioning and geometry thereof in such a way that there is no impairment of fuel injection via the injection openings leading to the combustion chamber.

According to one embodiment, at least one protuberance is formed on the valve seat.

According to one embodiment, the catalytic coating is formed on at least one of the protuberances.

According to the disclosure, the catalytic coating may be formed, in particular, around the injection openings, in order to reduce the deposits in this region as well as possible or to avoid them completely. The protuberances serve to conduct more heat into the surface and thus to start the catalytic process. However, the protuberances too may also be as free as possible from deposits and may therefore likewise be catalytically coated.

According to one embodiment, the valve element has a valve needle and a valve ball arranged at one end of the valve needle.

A typical construction of an injection valve 1 according to the prior art is first of all explained below with reference to FIG. 2.

Figure 2:
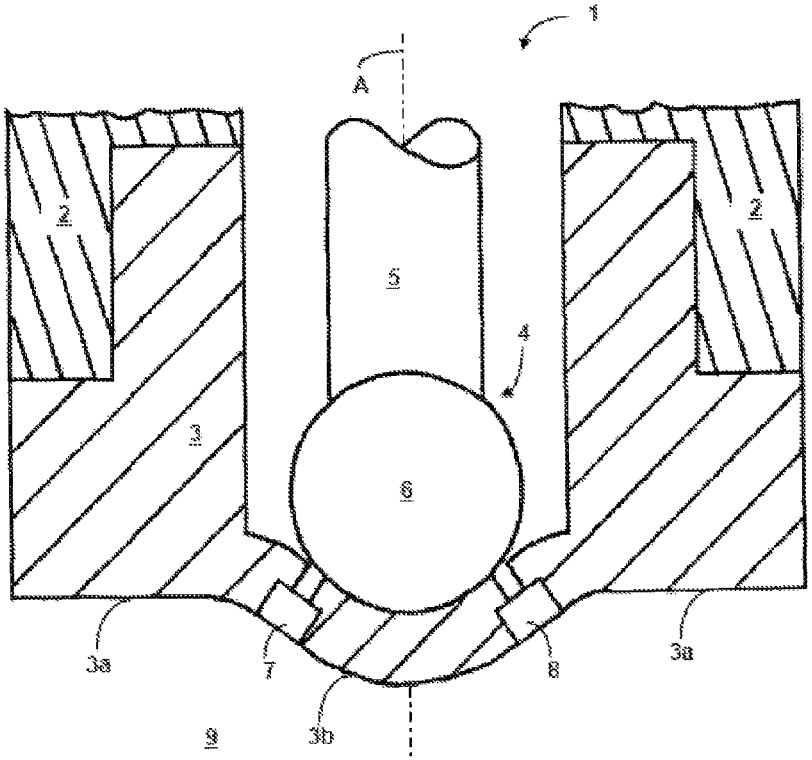
FIG. 2 Prior art
FIG. 2 shows a schematic illustration of an injection valve according to the prior art.

According to FIG. 2, this injection valve 1 has a valve seat 3, which is fixed on a valve housing 2 (e.g. by welding), and a valve element 4, which is formed by a valve needle 5 that extends along the longitudinal axis "A" of the injection valve 1 and is arranged so as to be able to perform a stroke motion along said longitudinal axis A and by a valve ball 6 arranged in the end section of said valve needle 5. By a stroke motion of the valve element 4 and of the associated valve ball 6, injection openings 7, 8 formed within the valve seat 3 and leading to the combustion chamber 9 can be opened or closed, wherein, when the injection openings 7, 8 are opened, fuel or a spray mist containing the fuel enters the combustion chamber 9 from the fluid space situated between the valve seat 3 and the valve element 4 at suitable angles in accordance with the alignment of the injection openings 7, 8.

According to FIG. 2, surface regions in which the valve seat 3 is in contact with the combustion chamber 9 are denoted by "3*a*" and "3*b*". At least in a partial region of these surface regions 3*a*, 3*b*, a catalytic coating is provided, as already explained at the outset, by which catalytic conversion of unwanted (in particular fuel or soot) deposits is accomplished if the temperature is sufficiently high (in particular above the light off temperature). Suitable materials for catalytic coatings of this kind are known to those skilled in the art from DE 199 51 014 A1, for example, and can contain cobalt (Co), nickel (Ni), cobalt oxides or nickel oxides, oxides of cobalt or nickel alloys or even noble metals (e.g. Ru, Rh, Pd, Os, Ir or Pt), for example.

FIG. 1 shows a schematic illustration of an injection valve 10 (also referred to as fuel injector 10) according to one embodiment of the present disclosure, which allows more efficient use of the catalytic coating describe above. Here, components that are similar to or operate substantially in the same way as those in FIG. 2 are denoted by corresponding reference numerals incremented by "10".

According to FIG. 1, the injection valve 10 according to the disclosure differs from the conventional injection valve 1 from FIG. 2 in that the valve seat 13 has two protuberances (or bulges) 20, 21 projecting into the combustion chamber 19 (through the use of additional material in the region thereof adjoining the combustion chamber 19). Moreover, catalytic coatings 20*a*, 21*a* are provided on the surfaces of said protuberances 20, 21 in the illustrative embodiment in FIG. 1.

In the illustrative embodiment shown (although the disclosure is not restricted thereto), the injection valve 10 has, in particular, a first protuberance 20, which is arranged radially on the inside in relation to the longitudinal axis thereof (denoted by "A"), and a second protuberance 21, which is arranged radially on the outside in relation to the longitudinal axis A of the injection valve 10. Thus, first protuberance 20 may extend out from the injection valve 10 (e.g., from valve seat 13) at a central longitudinal axis A of injection valve 10. In some examples, valve seat 13 may also include a protuberance that extends out into the combustion chamber. First protuberance 20 may be separate from the protuberance of the valve seat, although it may have a similar shape. In this case, the first protuberance 20 has a substantially conical or frustoconical geometry which tapers in the direction of the middle of the combustion chamber.

The second protuberance 21 may be an encircling collar in relation to the longitudinal axis A of the injection valve 10. That is, second protuberance 21 may be an annular ring positioned on an outside of the injection valve 10. As such, first protuberance 20 may be proximate central longitudinal axis A while second protuberance 21 encircles and is distal to first protuberance 20 and central longitudinal axis A.

In some examples, first protuberance 20 may be at least twice as long as second protuberance 21. A length of first protuberance 20 may be greater than or equal to a width of first protuberance 20. The length of first protuberance 20 may be set such that first protuberance 20 does not contact a piston of the combustion chamber when the piston is at top dead center. While first protuberance 20 is illustrated as having a conical or frustoconical geometry with a distal end centered over longitudinal axis A, other configurations are possible. For example, first protuberance 20 may be square-shaped, rounded, cylindrical, parabolic, or other shape. First protuberance 20 may have one or more distal ends centered over or offset from longitudinal axis A. First protuberance 20 may have a shape optimized to absorb heat from the combustion chamber and conduct the heat to other regions of the injection valve 10.

Similarly, second protuberance 21 may have other suitable shapes. For example, rather than being a continuous annular ring, second protuberance 21 may include a plurality of protuberances arranged in a circle around first protuberance 20. Second protuberance 21 is illustrated as having a first, substantially straight exterior side extending from an outer wall of valve seat and a second, tapered interior side. However, in some embodiments, the first side may be tapered and/or the second side may be straight. The first side of second protuberance may be aligned with the exterior wall of the valve seat, or it may be offset from the exterior wall. A width of second protuberance 21 may be equal to or greater than a length of second protuberance 21.

First protuberance 20 and second protuberance 21 may comprise a material similar to the material of valve seat. In other embodiments, first protuberance 20 and second protuberance 21 may comprise a different material that has a higher heat capacity and/or conductance than the material of the valve seat.

First protuberance 20 and second protuberance 21 may be in face-sharing contact with valve seat 13. In other embodiments, first protuberance 20 and/or second protuberance 21 may be indirectly coupled to valve seat 13.

As can likewise be seen from FIG. 1, the injection openings 17, 18 are arranged between the first protuberance 20 and the second protuberance 21 in the radial direction—relative to the longitudinal axis A of the injection valve 10. The geometry chosen ensures that the protuberances 20, 21 do not lead to impairment or restriction of the spray mist entering the combustion chamber 19 via the injection openings 17, 18. As such, second protuberance 21 may be shorter than first protuberance 20 to allow the spray mist to enter the combustion chamber without being disrupted by second protuberance 21. However, the disclosure is not restricted to the specific arrangement of the injection openings 17, 18 and, in particular, it is also possible to provide more injection openings or even just one injection opening.

Figure 4:
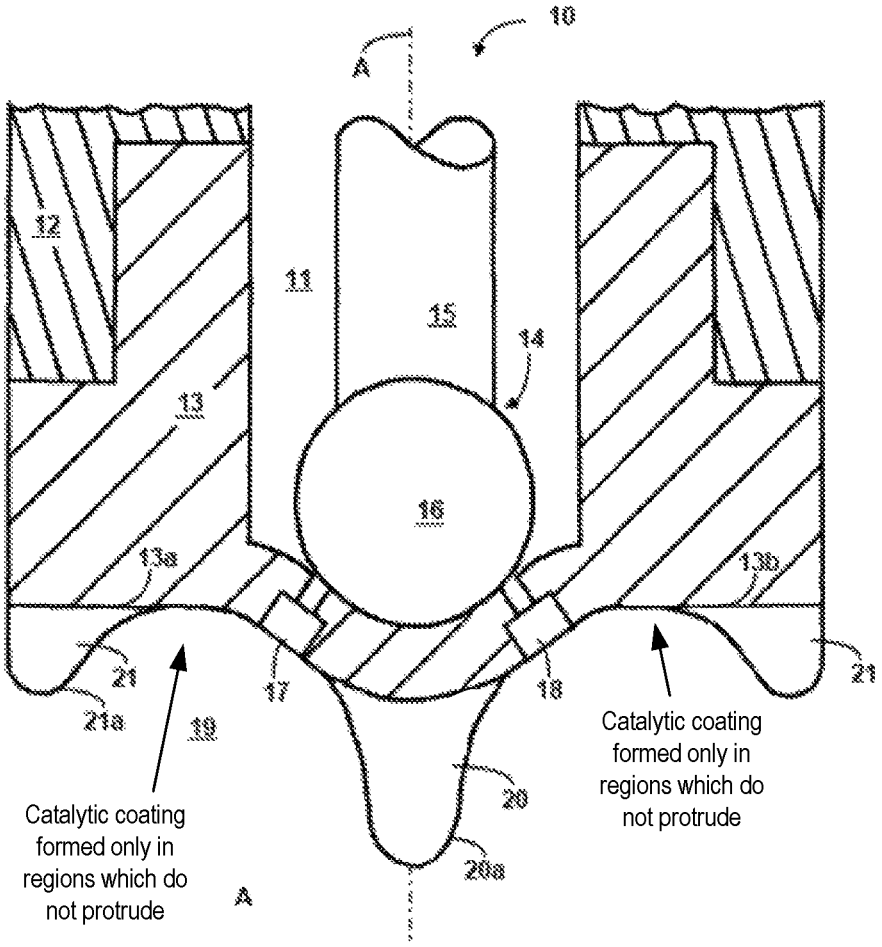
FIG. 4 shows a schematic illustration of an injection valve according to another embodiment of the disclosure.

Although the catalytic coating 20*a*, 21*a* is formed directly on the protuberances 20, 21 in the illustrative embodiment shown, the disclosure is not restricted thereto. In further embodiments, such as shown at FIG. 4, the catalytic coating can also be provided partially or completely in surface regions which do not protrude (e.g., on surfaces of valve seat between first protuberance 20 and second protuberance 21), on that side of the injection valve 10 and of the valve seat 13 which faces the combustion chamber 19, since, in such arrangements too, the thermal energy absorbed from the combustion chamber 19 by the protuberances is conducted via the material of the injection valve 10 and of the valve seat 13 toward the regions of the respective catalytic coating and can likewise contribute to an increase in the efficiency thereof.

The disclosure is not restricted to the specific geometry, shown in FIG. 1, of the injection valve 10, particularly in the region adjoining the combustion chamber 19. Thus, the present disclosure may also be taken to include further embodiments in which at least one protuberance is provided in such a way that increased absorption of thermal energy from the combustion chamber and hence more rapid and/or more frequent exceeding of the light off temperature of the catalytic coating is achieved during the operation of the internal combustion engine.

Figure 3:
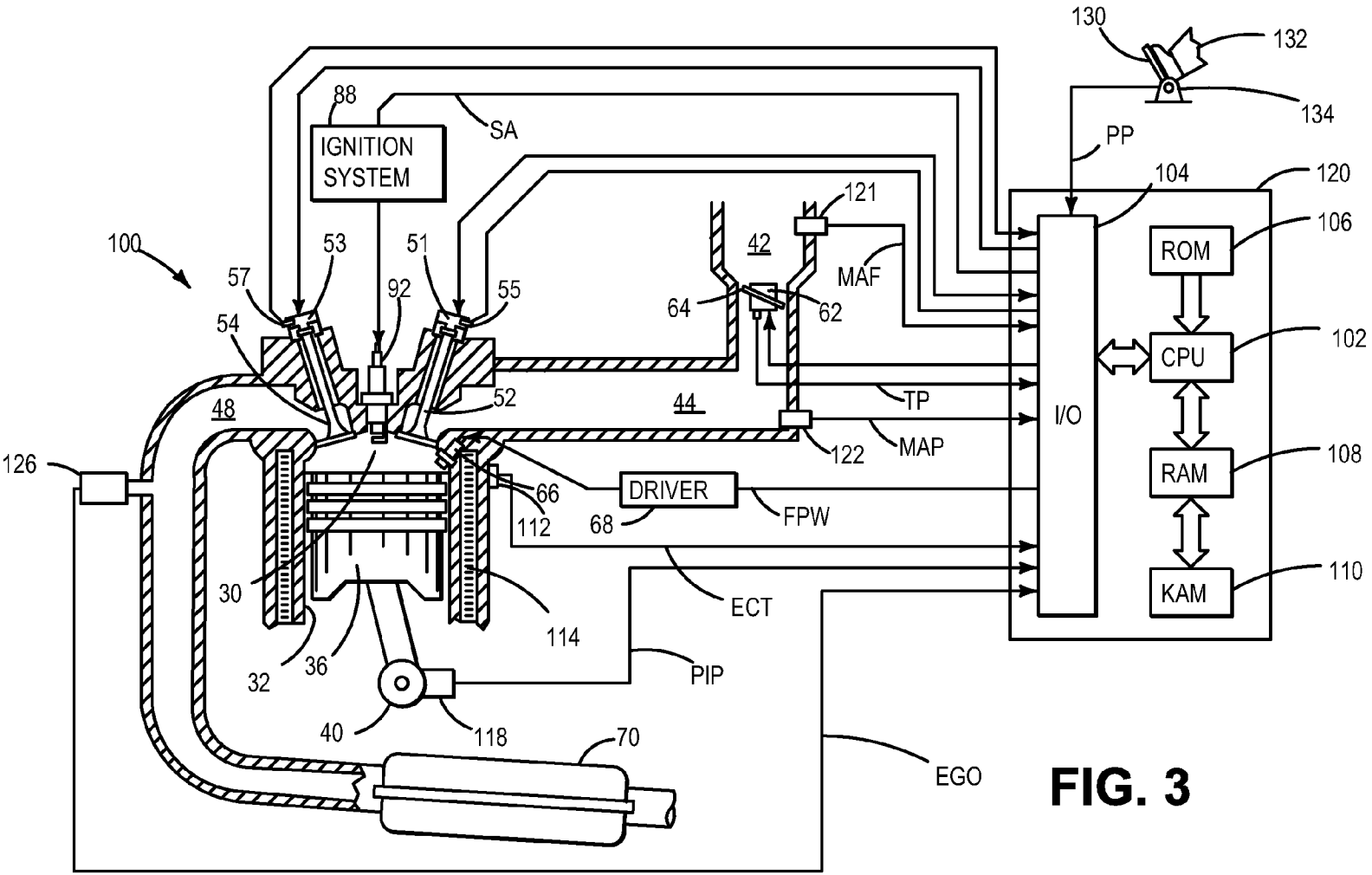
FIG. 3 shows a schematic illustration of an engine including the injection valve of FIG. 1.

FIG. 3 shows a schematic diagram of one cylinder of multi-cylinder engine 100, which may be included in a propulsion system of an automobile, for example. Engine 100 may be controlled at least partially by a control system including controller 120 and by input from a vehicle operator 132 via an input device 130. In this example, input device 130 includes an accelerator pedal and a pedal position sensor 134 for generating a proportional pedal position signal PP. Combustion chamber (i.e. cylinder) 30 of engine 100 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 100.

Combustion chamber 30 may receive intake air from intake passage 44 via intake manifold 42 and may exhaust combustion gases via exhaust passage 48. Intake passage 44 and exhaust passage 48 can selectively communicate with combustion chamber 30 via respective intake valve 52 and exhaust valve 54. In some embodiments, combustion chamber 30 may include two or more intake valves and/or two or more exhaust valves.

Intake valve 52 may be controlled by controller 120 via electric valve actuator (EVA) 51. Similarly, exhaust valve 54 may be controlled by controller 120 via EVA 53. During some conditions, controller 120 may vary the signals provided to actuators 51 and 53 to control the opening and closing of the respective intake and exhaust valves. The position of intake valve 52 and exhaust valve 54 may be determined by valve position sensors 55 and 57, respectively. In alternative embodiments, one or more of the intake and exhaust valves may be actuated by one or more cams, and may utilize one or more of cam profile switching (CPS), variable cam timing (VCT), variable valve timing (VVT) and/or variable valve lift (VVL) systems to vary valve operation. For example, cylinder 30 may alternatively include an intake valve controlled via electric valve actuation and an exhaust valve controlled via cam actuation including CPS and/or VCT.

Fuel injector 66 is shown coupled directly to combustion chamber 30 for injecting fuel directly therein in proportion to the pulse width of signal FPW received from controller 120 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system including a fuel tank and fuel pump (not shown). In some embodiments, combustion chamber 30 may alternatively or additionally include a fuel injector arranged in intake passage 44 in a configuration that provides what is known as port injection of fuel into the intake port upstream of combustion chamber 30. For example, a gasoline engine may employ direct injection fuel injectors (DI) whereas a diesel engine may employ port fuel injectors (PFI) to deliver fuel to the engine for combustion. Fuel injector 66 is one non-limiting example of fuel injector 10 of FIG. 2. As such, fuel injector 66 may include one or more protuberances projecting into combustion chamber 30, as described above with respect to FIG. 2.

Intake manifold 42 may include a throttle 62 having a throttle plate 64. In this particular example, the position of throttle plate 64 may be varied by controller 120 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 120 by throttle position signal TP. Intake manifold 42 may include a mass air flow sensor 121 and a manifold air pressure sensor 122 for providing respective signals MAF and MAP to controller 120.

Ignition system 88 can provide an ignition spark to combustion chamber 30 via spark plug 92 in response to spark advance signal SA from controller 120, under select operating modes. Though spark ignition components are shown, in some embodiments, combustion chamber 30 or one or more other combustion chambers of engine 100 may be operated in a compression ignition mode, with or without an ignition spark.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof. In some embodiments, during operation of engine 100, emission control device 70 may be periodically reset by operating at least one cylinder of the engine within a particular air/fuel ratio.

Controller 120 is shown in FIG. 3 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 120 may receive various signals from sensors coupled to engine 100, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 120 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Note that FIG. 3 shows only one cylinder of a multi-cylinder engine, and that each cylinder may similarly include its own set of intake/exhaust manifold valves, fuel injector, spark plug, etc. In one example, the engine cylinders may operate in a particular predetermined firing order, as determined by the valve timing.

Thus, the systems described herein provide for a fuel injector, comprising: a valve mechanism and a valve seat; a first protuberance extending out from the valve seat at a central longitudinal axis of the fuel injector; a second protuberance extending out from the valve seat in a radial direction around the first protuberance; at least one injector opening arranged between the first protuberance and the second protuberance; and a catalytic coating formed on at least the first protuberance.

In an example, the catalytic coating is additionally or alternatively formed on the second protuberance. In another example, the catalytic coating is additionally or alternatively formed around the at least one injector opening.

The first protuberance may have a length that is at least 50% of a width of the first protuberance, and the second protuberance may have a length that is at least 50% of a width of the second protuberance.

The at least one injector opening may comprise a plurality of injector openings arranged obliquely to a longitudinal axis of the injector. The valve mechanism may comprise a valve needle and a valve ball arranged at one end of the valve needle.

In an embodiment, a system comprises an engine including a combustion chamber; and a direct fuel injector for injecting fuel into the combustion chamber. The fuel injector comprises a valve mechanism and a valve mechanism seat; a first protuberance extending out from the valve mechanism seat into the combustion chamber at a central longitudinal axis of the fuel injector; a second protuberance extending out from the valve mechanism seat into the combustion chamber in a radial direction around the first protuberance; at least one injector opening formed in the valve mechanism seat and arranged between the first protuberance and the second protuberance; and a catalytic coating formed on at least the first protuberance and the second protuberance, wherein the first protuberance has a length that is at least 50% of a width of the first protuberance, and wherein the second protuberance has a length that is at least 50% of a width of the second protuberance.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An injection valve for injecting fuel into a combustion chamber of an internal combustion engine, comprising:

a valve seat protruding into the combustion chamber along a central longitudinal axis of the injection valve, the valve seat having a first protuberance and a second protuberance extending therefrom, the first protuberance distinct from and adjacent to the second protuberance of the valve seat;

a valve element;

a plurality of injection openings formed in the valve seat, arranged between the first and second protuberances in a radial direction, and leading to the combustion chamber, the injection openings opened or closed by a stroke motion of the valve element; and a catalytic coating provided in a region of the injection valve which faces the combustion chamber; wherein the first and second protuberances are elongated in a direction of the combustion chamber and project into the combustion chamber; and the first protuberance is a single protuberance, being the only protuberance located radially interior to the plurality of injection openings, wherein the second protuberance comprises a plurality of protuberances arranged in a circle around the first protuberance projecting into the combustion chamber.

2. The injection valve as claimed in claim 1, wherein in relation to a longitudinal axis of the injection valve, the protuberances have an axial extent which is at least 50% of an extent of said protuberances in a direction perpendicular to the longitudinal axis of the injection valve.

3. The injection valve as claimed in claim 1, wherein the first protuberance is arranged radially on an inside in relation to a longitudinal axis of the injection valve, and the second protuberance is arranged radially on an outside in relation to the longitudinal axis of the injection valve.

4. The injection valve as claimed in claim 3, wherein the first protuberance has a substantially conical geometry which tapers in the direction of the combustion chamber.

5. The injection valve as claimed in claim 3, wherein the second protuberance is an encircling collar in relation to the longitudinal axis of the injection valve, the encircling collar being a single protuberance in a continuous annular shape.

6. The injection valve as claimed in claim 3, wherein the plurality of injection openings is arranged obliquely to the longitudinal axis of the injection valve.

7. The injection valve as claimed in claim 1, wherein the protuberances are formed on the valve seat, and wherein the second protuberance extends toward a cylinder a shorter distance than the first protuberance.

8. The injection valve as claimed in claim 1, wherein the catalytic coating is formed on the first and second protuberances.

9. The injection valve as claimed in claim 1, wherein the catalytic coating is formed around the plurality of injection openings, and the catalytic coating is formed only in regions which do not protrude.

10. The injection valve as claimed in claim 1, wherein the valve element comprises a valve needle and a valve ball arranged at one end of the valve needle.

11. The injection valve as claimed in claim 1, wherein in relation to a longitudinal axis of the injection valve, the second protuberance has an axial extent which is less than or equal to an extent of said protuberance in a direction perpendicular to the longitudinal axis of the injection valve.

12. A fuel injector, comprising:

a valve mechanism and a valve seat, the valve seat protruding out towards a combustion chamber in a region around a central longitudinal axis of the fuel injector;

a first protuberance extending out from the valve seat at the central longitudinal axis of the fuel injector, the first protuberance distinct from and abutting the protruding out of the valve seat;

a second protuberance extending out from the valve seat in a radial direction around the first protuberance;

a plurality of injector openings arranged between the first protuberance and the second protuberance in a radial direction; and a catalytic coating formed on the first and second protuberances, the catalytic coating being composed of a material capable of catalytic conversion of adhered fuel and soot particles, wherein the second protuberance comprises a plurality of protuberances arranged in a circle around the first protuberance projecting into the combustion chamber.

13. The fuel injector of claim 12, wherein the catalytic coating is formed around the plurality of injector openings, and the catalytic coating is additionally formed in regions of the valve seat which do not protrude.

14. The fuel injector of claim 12, wherein the first protuberance has a length that is at least 50% of a width of the first protuberance, and wherein the second protuberance has a length that is at least 50% of a width of the second protuberance.

15. The fuel injector of claim 12, wherein the plurality of injector openings is arranged obliquely to a longitudinal axis of the fuel injector.

16. The fuel injector of claim 12, wherein the valve mechanism comprises a valve needle and a valve ball arranged at one end of the valve needle.

17. The fuel injector of claim 12, wherein the valve seat is made of a first material and the first and second protuberances are made of a second material, the second material having a higher heat conductance than the first material.

18. A system, comprising:

an engine including a combustion chamber; and a direct fuel injector for injecting fuel into the combustion chamber, the fuel injector comprising:

a valve mechanism and a valve mechanism seat, the valve mechanism seat extending out towards the combustion chamber in a region around a central longitudinal axis of the fuel injector;

a first protuberance extending out from the valve mechanism seat into the combustion chamber at the central longitudinal axis of the fuel injector, the first protuberance distinct from and contiguous to the extending out of the valve mechanism seat;

a second protuberance extending out from the valve mechanism seat into the combustion chamber in a radial direction around the first protuberance;

a plurality of injector openings formed in the valve mechanism seat and arranged between the first protuberance and the second protuberance in a radial direction; and a catalytic coating formed on the first protuberance and the second protuberance, the catalytic coating being composed of a material capable of catalytic conversion of adhered fuel and soot particles, wherein the first protuberance has a length that is at least 50% of a width of the first protuberance, and wherein the second protuberance has a length that is at least 50% of a width of the second protuberance;

wherein the valve mechanism seat is made of a first material and the first and second protuberances are made of a second material, the second material having a higher heat conductance than the first material.

* * * * *